United States Patent [19]

Iino et al.

[11] Patent Number: 4,749,636

[45] Date of Patent: Jun. 7, 1988

[54] PHOTOSENSITIVE MEMBER WITH HYDROGEN-CONTAINING CARBON LAYER

[75] Inventors: Shuji Iino, Hirakata; Hideo Hotomi, Suita; Izumi Osawa, Ikeda; Mitsutoshi Nakamura, Osaka, all of Japan

[73] Assignee: Minolta Camera Kabushiki Kaisha, Osaka, Japan

[21] Appl. No.: 905,515

[22] Filed: Sep. 10, 1986

[30] Foreign Application Priority Data

| | | | |
|---|---|---|---|
| Sep. 13, 1985 | [JP] | Japan | 60-204154 |
| Sep. 13, 1985 | [JP] | Japan | 60-204155 |
| Sep. 13, 1985 | [JP] | Japan | 60-204156 |
| May 17, 1986 | [JP] | Japan | 61-112847 |

[51] Int. Cl.[4] ..... G03G 5/10

[52] U.S. Cl. ..... 430/58; 430/128

[58] Field of Search ..... 430/58, 60, 61, 62, 430/63, 64, 65, 128

[56] References Cited

U.S. PATENT DOCUMENTS

| | | | |
|---|---|---|---|
| 3,956,525 | 5/1976 | Yasuba | 427/41 |
| 4,365,013 | 12/1982 | Ishioka et al. | 430/57 |
| 4,376,688 | 3/1983 | Ceasar et al. | 204/192 |
| 4,394,426 | 7/1983 | Shimizu et al. | 430/65 |
| 4,409,308 | 10/1983 | Shimizu et al. | 430/60 |
| 4,416,755 | 11/1983 | Caesar et al. | 204/192 |
| 4,451,546 | 5/1984 | Kawamura et al. | 430/69 |
| 4,452,874 | 6/1984 | Ogawa et al. | 430/57 |
| 4,465,750 | 8/1984 | Ogawa et al. | 430/57 |
| 4,466,380 | 8/1984 | Jansen et al. | 118/712 |
| 4,471,042 | 9/1984 | Komatzu et al. | 430/64 |
| 4,490,450 | 12/1984 | Shimizu et al. | 430/57 |
| 4,491,626 | 1/1985 | Kawamura et al. | 430/69 |
| 4,495,262 | 1/1985 | Matsuzaki et al. | 430/58 |
| 4,510,224 | 4/1985 | Yamazaki et al. | 430/57 |
| 4,513,022 | 4/1985 | Jansen et al. | 427/39 |
| 4,513,073 | 4/1985 | Jeffrey, III et al. | 430/65 |
| 4,518,670 | 5/1985 | Matsuzaki et al. | 430/58 |
| 4,522,905 | 6/1985 | Ogawa et al. | 430/60 |
| 4,544,617 | 10/1985 | Mort et al. | 430/58 |
| 4,557,987 | 12/1985 | Shirai et al. | 430/58 |
| 4,559,289 | 12/1985 | Sunagawa et al. | 430/66 |
| 4,579,801 | 4/1986 | Yashiki | 430/60 |
| 4,592,982 | 6/1986 | Saitoh et al. | 430/57 |
| 4,598,032 | 7/1986 | Saitoh et al. | 430/58 |
| 4,634,648 | 1/1987 | Jansen et al. | 430/95 |
| 4,686,164 | 8/1987 | Osawa et al. | 430/63 |

FOREIGN PATENT DOCUMENTS

| | | |
|---|---|---|
| 194329 | 3/1985 | European Pat. Off. . |
| 3525908 | 7/1984 | Fed. Rep. of Germany . |
| 51-46130 | 4/1976 | Japan . |
| 55-86169 | 6/1980 | Japan . |
| 56-60447 | 5/1981 | Japan . |
| 150753 | 10/1981 | Japan . |
| 11552 | 4/1982 | Japan . |
| 154850 | 4/1983 | Japan . |
| 88753 | 5/1983 | Japan . |
| 171038 | 7/1983 | Japan . |
| 59-28161 | 2/1984 | Japan . |
| 59-38753 | 3/1984 | Japan . |
| 214859 | 7/1984 | Japan . |
| 137977 | 4/1985 | Japan . |
| 63541 | 4/1985 | Japan . |
| 61761 | 5/1985 | Japan . |
| 60-125846 | 7/1985 | Japan . |
| 60-130747 | 7/1985 | Japan . |
| 61-243460 | 10/1986 | Japan . |

OTHER PUBLICATIONS

"A C-NMR Investigation of Plasma Polymerized Ethane, Ethylene, and Acetylene" by A. Dilks, S. Kaplan, and A. Vanlaeken, Xerox Webster Research Center, Xerox Square, W-114, Rochester, N.Y. 14644.

*Primary Examiner*—John L. Goodrow

*Attorney, Agent, or Firm*—Burns, Doane, Swecker & Mathis

[57] ABSTRACT

The present invention provides a photosensitive member comprising a carrier transporting layer of hydrogen-containing carbon, which is excellent in a charge transportability, a chargeability, a rigidity and resistances to corona, acid, moisture and heat, and has so small residual potential.

12 Claims, 3 Drawing Sheets

PHOTOSENSITIVE MEMBER WITH HYDROGEN-CONTAINING CARBON LAYER

BACKGROUND OF THE INVENTION

The present invention relates to a photosensitive membrane, particularly to a photosensitive member comprising a hydrogen-containing carbon layer as a charge transporting layer.

The technique of an electrophotography has been remarkably developed since the invention of the image-transfer type, and also various new materials have been developed and have been practised.

The main materials for conventional electrophotosensitive members include inorganic compounds such as non-crystalline selenium, selenium-arsenic, selenium-tellurium, zinc oxide, amorphous silicon and the like, and organic compounds such as polyvinylcarbazole, metal phthalocyanine, dis-azo pigments, tris-azo pigments, perillene pigments, triphenylmethanes, triphenylamines, hydrazones, styryl compounds, pyrazolines, oxazoles, oxadiazoles and the like.

Structures of electrophotosensitive members include a single layer type using one of the above compounds, a binder type in which the above compounds are dispersed in a binder resin, and multilayer type carrier generating layers and carrier transporting layers.

All conventional materials for electrophotosensitive members, however, have defects, one of which is poisonous for humans. Additionally, in order to use these electrophotosensitive members in a copying machine, the initial properties must be kept constant when they are exposed to the serious copying conditions of charge, exposure, development, transference, erasing, cleaning and the like. Many organic compounds are poor in durability, and have many unstable properties.

Recently, in order to improve the above problems amorphous silicon (referred to as a—Si hereinafter) formed by a plasma chemical vapor deposition (referred to as plasma CVD) has been applied to produce a photosensitive member.

A—Si photosensitive members have several excellent properties. But the relative dielectric constant ($\epsilon$) of a—Si is so large (about 12) that it essentially needs a thickness of at least 25 $\mu$m to gain a sufficient surface potential for a photosensitive member. In addition, in the production of an a—Si photosensitive member by plasma CVD a long production time is needed because of a slow deposition rate of an a—Si layer, and the long deposition time makes it difficult to obtain a homogeneous a—Si layer with the result that image defects such as white spot noises are liable to occur at a high percentage. Further, the cost becomes expensive.

Though many attempts to improve the above defects have been made, it is not preferred to make the layers thinner.

On the other hand, an a—Si photosensitive member has additional defects such as weak adhesive strength between the a—Si layer and electroconductive substrate, and poor resistances to corona, external circumstances and chemicals.

It has been proposed to use an organic polymeric layer produced by plasma polymerization (referred to as OPP layer hereinafter) which is arranged as an overcoat layer or an undercoat layer in order to solve the above problems. The former is proposed, for instance, in U.S. Pat. No. 3,956,525, and the latter is done in Japanese Patent Kokai No. 63541/1985.

It is known that an OPP layer can be produced from various kinds of organic compound such as ethylene gas, benzenes, aromatic silanes and the like (e.g. Journal of Applied Polymer Science Vol. 17, 885–892 (1973), by A. T. Bell et al.). However, the OPP layer produced by these conventional methods is restrictively used as an insulator. Therefore, the layer is considered as an insulating layer having an electrical resistance of about $10^{16}$ $\Omega$.cm such as an ordinary polyethylene layer or at least similar to such a layer.

Recently, there is proposed a layer comprising diamond-like carbon in the semiconductor field. But charge transportability thereof has not been suggested at all.

U.S. Pat. No. 3,956,525 discloses a photosensitive member consisting of a substrate, a sensitizing layer, an organic photoconductive electrical insulator and a glow discharging polymer layer having a thickness of 0.1–1 $\mu$m in the above order. This polymer layer is provided to cover the surface so as to stand up to wet development as an overcoat. Carrier transportability of the layer is not suggested.

Japanese Patent Kokai No. 63541/1980 discloses a photosensitive member comprising an undercoat layer composed of a diamond-like carbon and having a thickness of 200 Å to 2 micron and an a—Si photoconductive layer formed on said undercoat layer. This undercoat layer is formed to improve adhesion of the a—Si layer to the substrate. The undercoat layer may be so thin that a charge moves through it by tunnel effect.

As mentioned above, photosensitive members have been proposed which comprises an undercoat layer composed of an electrically insulating OPP layer, a diamond-like layer and the like, but charge transportability is basically attributed to the tunnel effect and the phenomena of dielectric breakdown.

The tunnel effect is caused due to the pass of electrons, when the thickness of an insulating layer is very thin (generally at an Angstrom unit).

The dielectric breakdown phenomenon is where existing small amounts of charge carriers are accelerated by an electric field to gain a sufficient energy capable of ionizing atoms in the insulator, with the result that carriers increase by the ionization. This phenomena occurs at a high electric field (generally more than 100 V/$\mu$m).

In the case of a photosensitive member having laminated layers of an insulating layer and a semiconducting layer, charges generated in the semiconducting layer move through the layer under an electric field, but they can not pass through the insulating layer under a low electrical field. If the insulating layer is thin, it is ignored as a surface potential or it does not affect adversely properties of photosensitivity because of negligible development influence. Further, even if the charges are accumulated on the insulating layer by repeated use to give a higher potential, the potential in the electric field does not increase above a constant level (e.g. 100 V/$\mu$m) because of the dielectric breakdown.

For example, when an insulating layer comprising insulating materials capable of causing dielectric breakdown at 100 V/$\mu$m is formed at a thickness of 0.1 $\mu$m, the increase of the residual potential based on the repetition is only 10 V.

According to the above reasons, it has been understood that if a conventional insulating layer is used in a photosensitive member, the thickness of the layer has to be less than about 5 μm, or else the residual potential based on the insulating layer increases to more than 500 V, so that an overlap of copied image occurs.

SUMMARY OF THE INVENTION

The primary object of the present invention is to provide a photosensitive member which is free of the above-mentioned drawbacks, is excellent in charge transportability and chargeability, and is capable of obtaining a good copy image.

Another object of the invention is to provide a photosensitive member capable of producing at lower cost and producing within short time.

Still another object of the invention is to provide a photosensitive member comprising a charge transporting layer which has excellent corona resistance, acid resistance, humid resistance, heat resistance and rigidity.

These and other objects of the invention can be accomplished by providing a photosensitive member which comprises an electrically conductive substrate, a charge generating layer and a charge transporting layer comprising a hydrogen-containing carbon, said hydrogen being contained in an amount of about 0.1 to 67 atomic % based on the amount of carbon.

DETAILED DESCRIPTION OF THE INVENTION

Figure 1:
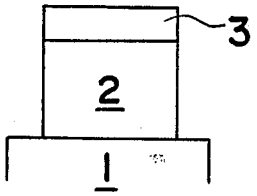
FIGS. 1–12 are schematic sectional views of photosensitive members of the present invention.

FIG. 1 shows an embodiment of a photosensitive member of according to the invention to illustrate the construction thereof. The photosensitive member comprises an electrically conductive substrate (1), a hydrogen-containing carbon layer (2) (referred to as the C:H layer hereinafter) which functions as a charge transporting layer, and a charge generating layer (3). Said C:H layer includes hydrogen in an amount of about 0.1 to 67 atomic % based on the amount of carbon.

An electrophotosensitive member requires a dark resistance of not less than $10^9$ Ω.cm and a ratio of light-/dark resistance (i.e. gain) of at least $10^2$ to $10^4$, even in a functionally separating photosensitive member.

The photosensitive member of the present invention is constituted by the carrier generating layer (3) and the C:H layer (2), which functions as a carrier transporting layer.

The C:H layer (2) contains hydrogen at 0.1 to 67 atomic percent based on carbon, preferably 1 to 60 atomic percent, more preferably 30 to 60 atomic percent, and most preferably 40 to 58 atomic percent. The C:H layer having less than 0.1 atomic percent gives a dark resistance unsuitable for electrophotography, and more than 67 atomic percent will not give carrier transportability.

The C:H carbon layer of the present invention can be produced as an amorphous carbon or a diamond-like carbon according to the hydrogen content or the process for production. For the most part, an amorphous C:H layer is obtained, which is soft and of high resistance to electricity. However, when the layer having a hydrogen content of less than about 40 atomic percent is produced by the plasma CVD method, a diamond-like carbon layer can be obtained. Such a layer is harder having a Vickers hardness of more than 2000 and has the resistance of more than $10^8$ Ω.cm.

Further, the C:H layer of the present invention can be produced as a polymer layer, for example, a polymer layer formed by a plasma polymerization. A polymer layer formed by plasma polymerization a high density and rigidity, and is excellent in resistance to chemicals and heat. In addition, this polymer layer is characterized by a larger dielectric loss compared to general polymer layers, since free radicals are trapped in said polymer layer. A preferable polymer layer formed by plasma polymerization is a polyethylene layer formed by plasma polymerization. The ratio of hydrogen atoms to carbon atoms in said polyethylene layer is about 2.7 to 2. Moreover, this polyethylene layer has a good heat resistance, i.e., heat resistance to more than 330° C.

These polymer layers formed by plasma polymerization show excellent charge transportability when combined with charge generating layers.

Hydrogen content of the C:H layer and the structure thereof can be determined by elemental analysis, IR analysis, $^1$H-NMR, $^{13}$C-NMR and the like.

A C:H layer of the present invention has preferably an optical energy gap (Egopt) of 1.5 to 3.0 eV, and a relative dielectric constant (ε) of 2.0 to 6.0.

A C:H layer having a smaller Egopt (less than 1.5 eV) forms many levels at the near end of the bands, that is, at the lower end of the conduction band and the upper end of the filled band. Therefore, in this case the C:H layer is not always suitable as a charge transporting layer because of its smaller mobility of carriers and shorter carrier life. A C:H layer having a larger Egopt (more than 3.0 eV) has a tendency to make a barrier at the interface between the charge generating materials and the charge transporting materials which are ordinarily used for an electrophotosensitive member, so there are cases when the injection of carriers from the carrier generating layer and the carrier transporting layer to the C:H layer having a larger Egopt cannot be achieved. As a result, excellent photosensitive properties cannot be obtained.

In the meanwhile, where the relative dielectric constant (ε) is larger than 6.0, charging capacity and also sensitivity decrease. Increasing the thickness of the C:H layer has been considered in order to overcome these drawbacks, but the increase in thickness of the C:H layer is not desirable for production purposes. If the relative dielectric constant is less than 2.0, the properties of the layer become similar to those of polyethylene so as to reduce the charge transportability.

Hydrogen contained in the C:H layer (2) as a charge transporting layer may be partially substituted with halogens, for instance, fluorine, chlorine, bromine and the like. Such layers have improved water repellancy and abrasion resistance due to the substitution.

The thickness of the C:H layer (2) as a charge transporting layer is preferably about 5–50 μm, more preferably 7–20 μm. The C:H layer having a thickness of less than 5 μm has low charging capacity, with the result that a sufficient contrast can not be obtained on a copied image. The thickness of more than 50 μm is not desirable for production. The C:H layer has an excellent light transparency, a high dark resistance and a high charge transportability. Even if the thickness of the layer exceeds 5 μm, carriers can be transported without trapping.

The C:H layer (2) of the present invention may be produced under ionized conditions by ion vapor deposition, ion beam deposition and the like; under plasma conditions by direct current, high frequency, microwave plasma methods and the like; and through a neutral particle by reduced compression CVD, vacuum vapor deposition, sputtering methods, optical CVD and the like or a combination thereof. However, for instance, in the case that charge generating layers are produced by a high frequency plasma or CVD, it is desirable to produce C:H layers by the same method in the aspect of reduction of apparatus costs and labor saving.

Carbon sources for the C:H layer may include $C_2H_2$, $C_2H_4$, $C_2H_6$, $C_3C_6$, $CH_4$, $C_4H_{10}$, $C_4H_6$, $C_4H_8$, $C_3H_8$, $CH_3CHO$, $C_8H_8$, $C_{10}H_{16}$, and the like.

The carrier gas may preferably include $H_2$, Ar, Ne, He and the like.

According to the present invention an element belonging to IIIA group or VA group of the Periodic Table may be incorporated into the C:H layer (2) in order to control the charging properties of charge transporting layers.

Reverse bias effect may be achieved by making the substrate side P-type and the surface side N-type respectively, when the photosensitive member is used in a positively charged state, and by making the substrate side N-type and the surface side P-type respectively, when it is used in a negative charged state. In the above manner various effects such as improvement of charging capacity, a decrease of the reduction rate of surface potential in darkness and an improvement of sensitivity of the photosensitive member can be obtained.

The polarity may be controlled by gradually increasing an element of IIIA or VA group in the surface side or the substrate side within the same layer, or a single charge transporting layer comprising a C:H layer containing an element of IIIA or VA group may be arranged on the surface side or the substrate side. Alternatively, if necessary, plural C:H layers with different concentrations of an element of the IIIA or VA group may be arranged at conjunction areas so as to form depletion layers.

With reference to FIG. 1, if the photosensitive member is positively charged and then exposed to a light image, charge carriers are generated in the charge generating layer (3), and electrons are neutralize the surface charge. On the other hand the holes are transported to the substrate (1) under an excellent charge transportability of the C:H layer (2). Where the a—Si charge generating layer without any polarity control is positively charged, the C:H charge transporting layer is preferably controlled to be a relative P-type. Since a—Si itself is of weak N-type or intrinsic, it has a tendency to control the injection of positive charge from the surface, and a C:H charge transporting layer controlled to be a P-type facilitates movement of holes.

Elements of IIIA group which may be used to form a P-type may include B, Al, Ga, In and the like, especially B. The surface layer may be controlled to be a relatively higher N-type by incorporating elements of VA group such as P into the a—Si charge generating layer. In this case the C:H layer may be controlled to be a P-type. When the photosensitive member is used with a negative charge, the C:H layer (2) is controlled to be a N-type by incorporating P therein. When a—Si is used as a carrier generating layer, B may be incorporated therein.

FIGS. 2 to 12 show other embodiment of photosensitive members according to the invention to illustrate the constitution thereof.

Figure 2:
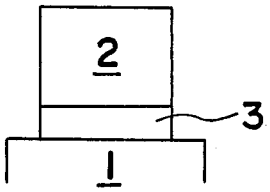

FIG. 2 illustrates a photosensitive member containing a C:H layer (2) as an outermost layer. When this member is used with a positive charge, the polarity of the C:H layer (2) may be controlled to be a N-type in comparison with the charge generating layer (3) by an element of the VA group so as to facilitate mobility of electrons. When the photosensitive member is used at a negative polarity, the C:H layer may be inversely controlled by incorporating B, for example.

Figure 3:
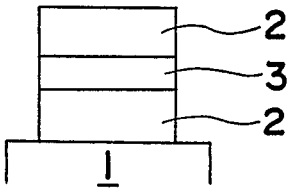

The photosensitive member of FIG. 3 is an embodiment containing a C:H layer (2) on the upper and lower sides of the charge generating layer (3). When it is used at a positive polarity, it is desirable to control the upper C:H layer (2) to be a N-type in comparison with the charge generating layer (3) so as to facilitate mobility of electrons, whereas the lower C:H layer (2) is controlled to be a P-type.

Figure 4:
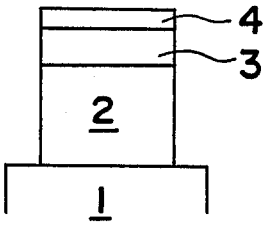
Figure 5:
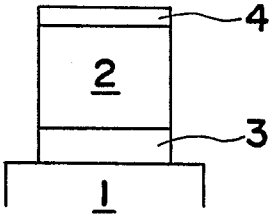
Figure 6:
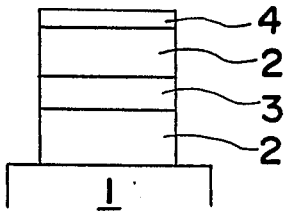

Photosensitive members illustrated in FIGS. 4–6 have an overcoat layer (4) on the photosensitive members of FIGS. 1–3. The overcoat layers act as a surface protective layer for a charge generating layer (3) or a C:H charge transporting layer (2), and improve the initial surface potential. The thickness of the overcoat layer is preferably about 0.01–5 μm. As a surface protective layer, any materials which are usually used therefor may be used. In the present invention the protective layer may preferably be formed by organic plasma polymerization for production reasons. The overcoat layer may be the C:H layer of the present invention. Elements of the IIIA or VA groups may be doped into the surface protective layer (4), if necessary.

Figure 7:
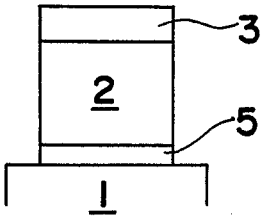
Figure 8:
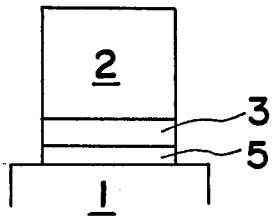
Figure 9:
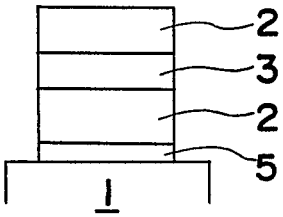
Figure 10:
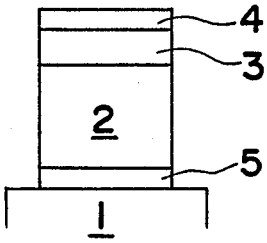
Figure 11:
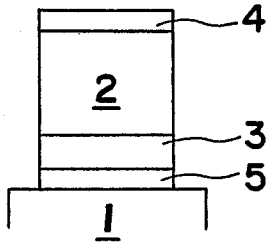
Figure 12:
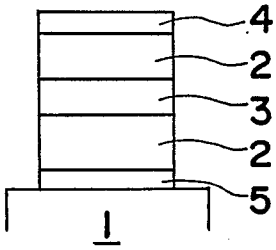

Photosensitive members of FIGS. 7–9 are examples in which a C:H layer used as a carrier transporting layer is applied to the substrate (1) to make it function as an undercoat layer, a barrier layer and/or an adhesive layer. As an undercoat layer, of course, conventional materials may be used. In such a case the undercoat layer may be preferably formed by organic plasma polymerization. A barrier layer inhibits injection of charge from the substrate and transports charges generated in the charge generating layer (3) to the substrate. Therefore, it is desirable to incorporate elements of the IIIA group when the charge generating layer is used with a positive polarity and elements of the VA group when it is used with a negative polarity. The thickness of the barrier layer is preferably about 0.01–5 μm. An overcoat layer (4) may be applied on photosensitive members of FIGS. 7–9 as illustrated in FIGS. 10–12.

In order to incorporate elements of the IIIA group into the C:H layer, suitable gaseous compounds containing these elements are deposited with hydrocarbon gas under an ionized state or a plasma state. Alternatively, the C:H layer may be exposed to gas containing elements of the IIIA group to be doped.

Compounds containing boron may include $B(OC_2H_5)_3$, $B_2H_6$, $BCl_3$, $BBr_3$, $BF_3$ and the like.

Compounds containing aluminum may include $Al(Oi—C_3H_7)_3$, $(CH_3)_3Al$, $(C_2H_5)_3AL$, $(i—C_4H_8)_3Al$, $AlCl_3$ and the like.

Compounds containing gallium may include $Ga(Oi—C_3H_7)_3$, $(CH_3)_3Ga$, $(C_2H_5)_3Ga$, $GaCl_3$, $GaBr_3$ and the like.

Compounds containing indium may include $In(Oi-C_3H_7)_3$, $(C_2H_5)_3In$ and the like.

The content of elements of IIIA group may be preferably not more than 20000 ppm, more preferably about 3-1000 ppm.

Elements of the VA group used for polarity control may be N, P, As, and Sb, especially P. The elements of VA group may be incorporated into the C:H layer in the same manner as the IIIA group.

Compounds containing elements of the VA group, useable in the present invention, may include $N_2$, $N_2O$, NO, $NO_2$ and the like as a compound containing N; $PO(OCH_3)_3$, $(C_2H_5)_3P$, $PH_3$, $POCl_3$ and the like as a compound containing P; $AsH_3$, $AsCl_3$, $AsBr_3$ and the like as a compound containing As; $Sb(OC_2H_5)_3$, $SbCl_3$, $SbH_3$ and the like as a compound containing Sb.

The content of the elements of VA groups is preferably not more than 20000 ppm, more preferably about 1-1000 ppm.

The properties of charge generating layer of the photosensitive members may be controlled by incorporating additional elements.

There are cases where the charge transporting layers are colored to, for instance, yellow, blue, brown or so according to a production condition or by impurity contamination. In the embodiments of FIGS. 2, 3, 4, 5, 6, 8, 9, 10, 11 and 12 such a phenomena may be utilized to prevent injurious light transmitting to the charge generating layers.

Surface barriers between the charge generating layers and the charge transporting layers may be made smaller by incorporating Si or Ge into the latter to control the band gap. In the embodiments of FIG. 1 a large quantity of Ge (more than 10 atomic %) may be incorporated into layers near the substrate, by which reflection of surplus light can be prevented, so that fringe interference and blurredness can be prevented.

Nitrogen, oxygen, sulfur and/or various kinds of metals may be additionally incorporated into the C:H charge transporting layers, or a part of hydrogen of the C:H layer may be substituted with halogen.

As a nitrogen source $N_2$, $NH_3$, $N_2O$, NO, $NO_2$ and the like may be used in general, and addition thereof can make the surface barrier smaller between charge generating layers and charge transporting layers. If nitrogen is incorporated into the C:H layers, $—NH_2—$. —N=N—, —NH— group and the like are formed in the C:H layers to act as a donor, so that the mobility of holes is improved.

As an oxygen source $O_2$, $O_3$, $N_2O$, NO and the like are exemplified. The incorporation of these compounds improves charging capacity, and can accelerate the plasma CVD layer formation rate.

As a sulfur source $CS_2$, $(C_2H_5)_2S$, $H_2S$, $SF_6$, $SO_2$ and the like are exemplified. The incorporation of sulfur is effective for the prevention of light absorption and light interference. The rate of the layer formation can also be made faster.

By the substitution of hydrogen in the C:H layer with halogen water repellance, rubbing resistance and light transmittance can be improved. Especially when fluorine —CF, $—CF_2$, $—CF_3$, and the like are used the refractive index (n) becomes smaller (eg. 1.39), so that reflection also becomes smaller.

If the C:H layer obtained according to the present invention is contacted with the atmosphere after argon treatment, carbonyl groups are formed on the surface of the layer to be activated. Additionally, the $—CF_2$ group of is changed to —CF.

By introduction of a small amount of Si or Ge a hard layer with rubbing resistance and water repellance can be produced. Further, the incorporation of both facilitates the injection of charge from a charge generating layer to give a desirable effect such as decrease of residual potential and increase of sensitivity.

As a source of carbon and halogen $C_2H_5Cl$, $C_2H_3Cl$, $CH_3Cl$, $CH_3Br$, $COCl_2$, $CCl_2F_2$, $CHClF_2$, $CF_4$, HCl, $Cl_2$, $F_2$ and the like may be used. Exemplified are $GeH_4$ as a source of germanium; $SiH_4$ as a source of silicon; $H_2Te$ as a tellurium; $H_2Se$ as a source of selenium; $AsH_3$ as a source of arsenic; $SbH_3$ as a source of antimony; $BCl_3$ and $B_2H_6$ as a source of boron; and $PH_3$ as a source of phosphorus.

Charge generating layers which may be used in the present invention are not restrictive. Any charge generating layers may be used. Examples of these layers may be a—Si layers which may contain various kinds of element to change the properties of the layers such as C, O, S, N, P, B, Ge, halogen and the like, and may be of multilayer structures; Se layers; Se—As layers; Se—Te layers; CdS layers; layers made by binding inorganic or organic charge generating compounds with resinous materials; and the like. Such inorganic compounds may include zinc oxide and the like, and such organic compounds may include bis-azo compounds, triarylmethane dye, thiazine dye, oxazine dye, xanthene dye, cyanine dye, styryl dye, pyryliums, azo compounds, quinacridones, indigos, perillenes polycyclic quinones, bisbezimidazoles, indanthrenes, squaliliums, phthalocyanines and the like.

Other compounds, so far as these can absorb light to generate carriers at high efficiency, can be used. Charge generating layers may be formed by any method.

The charge generating layers of the present invention may be arranged anywhere as described later, such as an outmost layer, an innermost layer or a middle layer. The thickness of the charge generating layers may be designed such that 90% of 555 nm light can generally be absorbed, which is depended on the kind of materials, especially spectrophotoabsorption properties, sources of light exposure, objects and the like. In the case of a—Si:H, the thickness of the layer is generally about 0.1-1 $\mu$m.

The photosensitive member of the present invention contains carrier generating layers and carrier transporting layers. Therefore, there are at least two processes needed to produce the member. When a—Si layers are formed using, for example, an apparatus adapted for glow discharge decomposition, plasma polymerization can be carried out in the same apparatus. Therefore, C:H charge transporting layers, surface protective layers, barrier layers and the like are preferably produced by the plasma polymerization.

Figure 13:
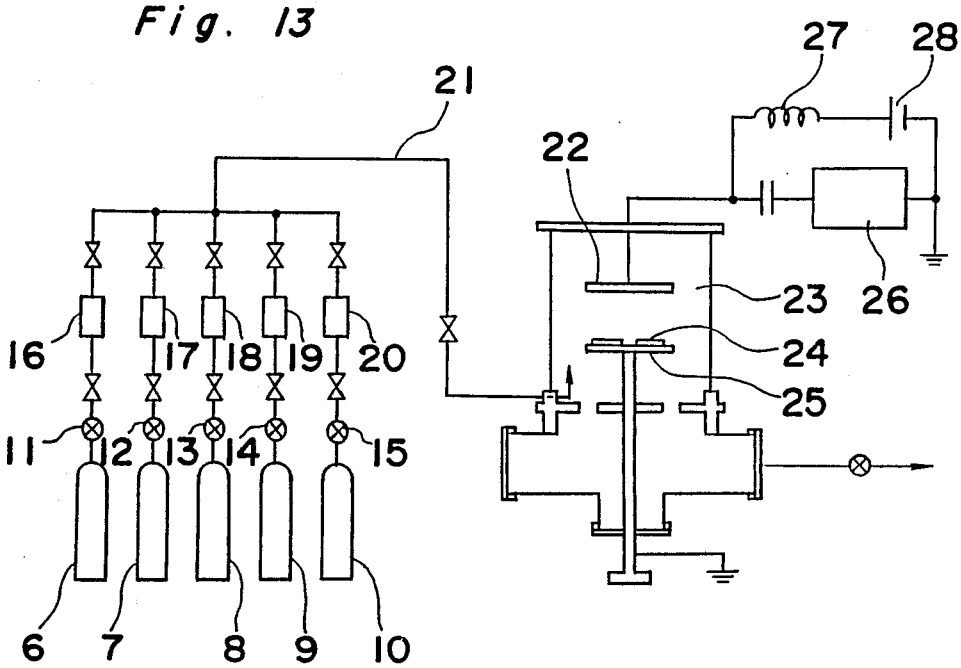
FIGS. 13–15 are examples of apparatus for production of photosensitive member of the present invention.
Figure 14:
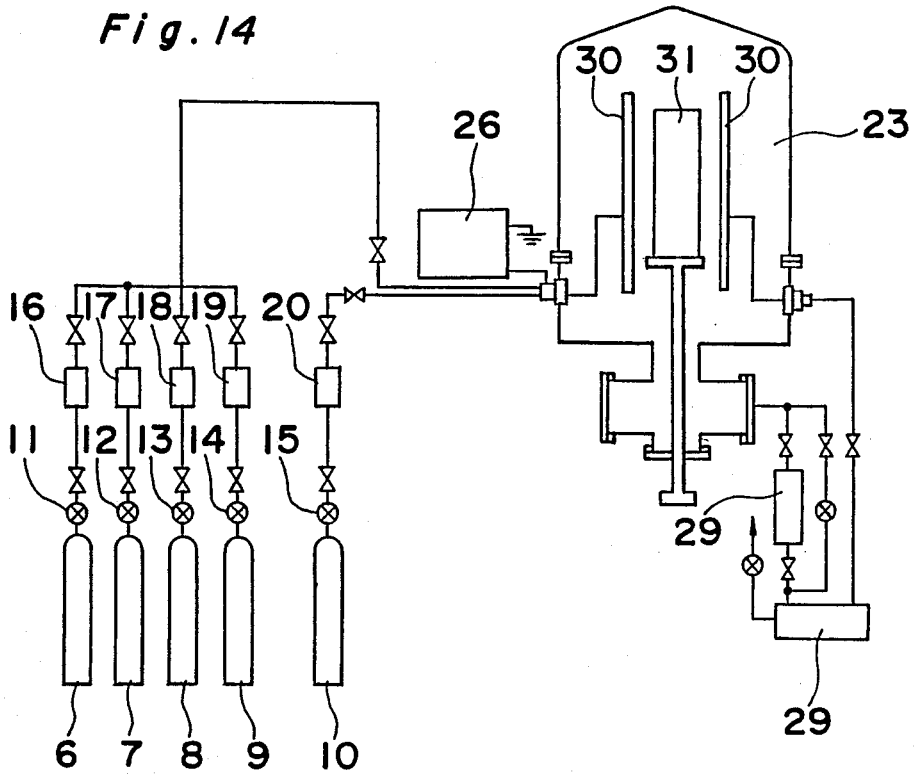

FIGS. 13 and 14 illustrate a capacitive coupling type plasma CVD apparatus for the production of the photosensitive member of the present invention. FIG. 13 shows a parallel plate type plasma CVD apparatus, and FIG. 14 shows a tubular plasma CVD apparatus. Both apparatuses are different in that electrodes (22) and (25) and the substrate (24) of FIG. 13 are plates, but in FIG. 14 an electrode (30) and the substrate (31) are tubular. In the present invention, of course, a photosensitive member can produced by an induction coupling type plasma CVD apparatus.

Production of the photosensitive member of the present invention is illustrated according to the parallel plate type plasma CVD apparatus (FIG. 13). In FIG. 13, (6)–(10) show the 1st to 5th tanks for $C_2H_4$, $H_2$, $B_2H_6$, $SiH_4$ and $N_2O$ gases respectively, each of which is connected to the 1st to 5th control valves (11)–(15) and the 1st to 5th mass flow controllers (16) to (20) respectively. These gases are sent to a reactor (23) through a main pipe (21).

In the reactor (23) a grounded electrode plate (25), on which the electroconductive substrate such as an Al plate (24) is arranged, is electrically connected with the plate-like electrode (22), which is connected with a high frequency current source (26), facing each other through a condenser. The electrode (22) is connected with a direct current source (28) through a coil (27) in such a manner that a bias is applied in addition to the electric power from the frequency current source (26). The electroconductive substrate (24) set on the electrode (25) is arranged such that it can be heated to, for example, 350° C. by a heating means (not illustrated).

When a photosensitive member illustrated in FIG. 1, for example, is prepared with $C_2H_4$, and $H_2$ gas as a carrier gas may be supplied from the first tank (6) and the second tank (7) respectively through the main pipe (21) after the reactor is maintained at a constant vacuum. Then an electric power of 0.03–1 kw is applied from the frequency current source (26) to the electrode (22) to cause plasma discharge between both electrodes to form a C:H charge transporting layer (2) 5 to 50 μm thick on a preheated substrate (24). The hydrogen content of the C:H charge transporting layer is depended on conditions for production such as the kind of starting material, the ratio of the material and the diluting gas ($H_2$ gas or inert gas such as He), discharging power, pressure, substrate temperature, DC bias, anneal temperature, and the frequency at discharge. The hydrogen content can be controlled by varying the bias from 0.05 to 1 kv. That is, the hydrogen content can be reduced by applying a higher bias so as to increase the hardness of the C:H layer. The C:H charge transporting layer obtained has excellent light transmittance, dark resistance and carrier transportability. The layer may be controlled to be a P type by the introduction of $B_2H_6$ gas from the third tank (8) and $N_2O$ gas from 5th tank (10) to further improve the charge transportability. If $PH_3$ gas is used instead of $B_2H_6$, the layer can be controlled to be an N type.

As a charge generating layer (3) a layer mainly made of a—Si may be applied by introduction of $H_2$ gas and $SiH_4$ from the 2nd tank (7) and the 4th tank (9) respectively.

The Egopt is dependent on a kind of starting gaseous materials, the ratio of the starting material to diluting gas ($H_2$ and inert gas etc.), charging power, pressure, substrate temperature, DC bias, anneal temperature, discharging frequency and the like. Especially, discharging power, substrate temperature and anneal temperature affect the Egopt.

The Egopt of the present invention can be calculated from the absorption edge by the formula of $\sqrt{\alpha h\nu}-h\nu$ wherein $\alpha$ represents the absorption coefficient and $h\nu$ represents light energy.

The relative dielectric constant of the C:H layer is dependent on the kind of starting gaseous material, the DC bias generated by discharge or applied from outside, discharging power and the like, and can be controlled by changing them.

Figure 15:
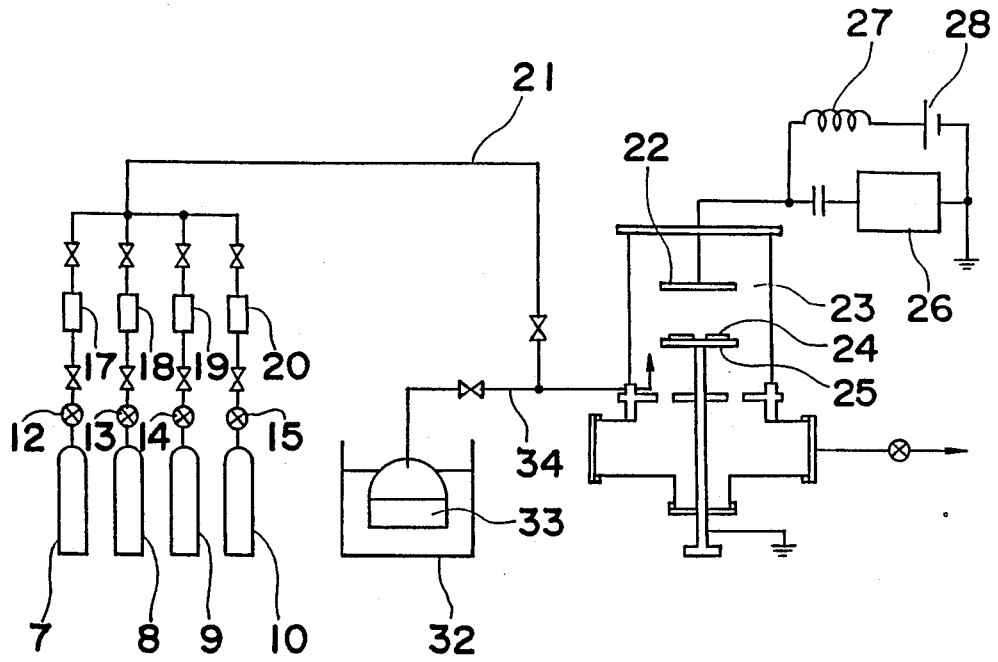

A capacitance coupling CVD apparatus as shown in FIG. 15 illustrates an embodiment using a monomer such as $C_8H_8$ as a source of the C:H layer, in which a monomer (33) in a constant temperature bath (32) as well as a pipe (34) connected with the reactor, is heated for introduction into the reactor (23) as a vapor. The other constitutions are the same as FIG. 13.

The photosensitive member of the present invention has an excellent charge transportability and charging capacity, and sufficient surface potentials can be obtained even when the thickness of the C:H layer is thin.

The production costs are low, and the time of production is short, because the cost of the raw materials are low, every layer can be formed in the same reactor, and the layers may be thin. Even a thin C:H layer can be easily produced without pin holes. If the C:H layer of the present invention is used as an outmost surface, durability of the photosensitive member is improved because of its excellent resistance to corona, acids, moisture, heat and rigidity.

The present invention is illustrated by the following examples, but it should not be construed restrictively to them.

EXAMPLE 1

(I) Formation of C:H Charge Transporting Layer

In the glow discharge decomposition apparatus shown in FIG. 13, the reactor (23) is evacuated to a high vacuum of about $10^{-6}$ Torr, and then the 1st and 2nd controlling valves (11) and (12) were opened to send $C_2H_4$ gas from the 1st tank (6) and $H_2$ gas from the 2nd tank (7) to mass flow controllers (16) and (17) respectively under an output gauge of 1 Kg/cm$^2$. Thereafter, the flow rate of $C_2H_4$ and $H_2$ gases were set on 30 sccm and 40 sccm respectively by adjusting the scales of the respective mass flow controllers, and the gases were sent to the reactor (23). After the flow rate of every gas was stabilized, the inner pressure of the reactor was adjusted to 0.5 Torr. Separately, an aluminum plate of 3×50×50 mm, the electroconductive substrate (24), was preheated to 250° C. When both the flow rate of the gases and the inner pressure were stabilized, a high-frequency power of 100 watts (frequency, 13.56 MHz) was applied to the electrode (22) from the power source (26) to continue plasma polymerization for 4 hours to form the C:H charge transporting layer of about 5 μm thick (H content: about 50 atomic %) on the substrate (24).

(II) Formation of a—Si Charge Generating Layer

The application of power from the high frequency power source (26) was temporarily stopped, and the reactor was evacuated.

The 4th and 2nd controlling valves (14) and (12) were opened to sent $SiH_4$ gas from the 4th tank (9) and $H_2$ gas from the 2nd tank (7) to mass flow controllers (19) and (17) respectively under an output gauge pressure of 1 Kg/cm$^2$. The flow rates of $SiH_4$ and $H_2$ were set on 90 sccm and 210 sccm respectively by adjusting the values of the mass flow controllers and both gases were sent to the reactor. After the flow rates were stabilized, the inner pressure of the reactor (23) was adjusted to 1.0 Torr.

When the flow rate and the inner pressure were stabilized, a high frequency power (frequency, 13.56 MHz) of 10 watts was applied to the substrate with the C:H charge transporting layer from the electrode (22) to generate glow discharge. This glow discharge was continued for 40 minutes to form a 1 μm thick a—Si charge generating layer.

The photosensitive member obtained had an initial surface charge (Vo) of 300 V, an exposure for half reduction of surface potential ($E_{\frac{1}{2}}$) of 2.0 lux.sec, an Egopt of 2.60 and a relative dielectric constant (ε) of 2.53. A clear copy was obtained from the resulting photosensitive member.

Conditions for production of the above photosensitive member and properties are shown in Table 1. In Table 1, o and Δ mean excellent and good respectively.

EXAMPLE 2

| Formulation | parts by weight |
|---|---|
| styrene | 200 |
| methyl methacrylate | 160 |
| n-butyl acrylate | 75 |
| β-hydroxypropyl acrylate | 55 |
| maleic acid | 8 |
| benzoyl peroxide | 7.5 |
| ethylene glycol monomethyl ether | 150 |

The mixture obtained from the above formulation was added dropwise to a reaction vessel containing xylene (350 parts by weight) with stirring under nitrogen atmosphere at 105° C. for 2 hours to react. After 2.5 hours elapsed since the initiation of the polymerization an additional benzoyl peroxide (0.5 part by weight) was added to react for 8 hours as stirring under heating to give a thermoset hydroxyl-containing acrylic resin (viscosity: 800 cps, solid: 50%).

The thermoset hydroxyl-containing acrylic resin (34 parts by weight), melamine resin (Super Beckamine J 820; available from Dainippon Ink & Chemicals Inc.) (6 parts by weight), 2,4,5,7-tetranitro-9-fluorenone (0.5 parts by weight), epsilon-copper phthalocyanine available from Toyo Ink Co., Ltd. (20 parts by weight), cellosolve acetate (40 parts by weight) and methyl ethyl ketone (40 parts by weight) were blended in a ball mill pot for 30 hours to give a photoelectroconductive paint. The obtained paint was coated on the surface of a C:H charge transporting layer obtained by the same manner as described in Example 1, dried and then cured to give a photosensitive member for electrophotography. The member had an electrophotoconductive layer of 1 μm in thickness, an initial surface potential ($V_0$) of +250 V, an exposure for half reduction of surface potential $E_{\frac{1}{2}}$ of 5 lux.sec, an Egopt of 2.60 and a relative dielectric constant (ε) of 2.53. Excellent copy was obtained from the photosensitive member. The results are shown in Table 1.

EXAMPLES 3-9

Photosensitive members were prepared according to the same manner as in Example 1 except that conditions of gaseous raw materials, flow rate of $H_2$, the pressure of the reactor, the applied power, the deposition time, preheating temperature of substrate, condition of application of bias and annealing were charged, and a CVD apparatus shown in FIG. 14 was used to form photosensitive layers on tubular substrate (31). The thickness of a—Si layer was controlled to 0.5 μm.

Conditions for the production of the photosensitive members and properties are shown in Table 1. The obtained photosensitive members were excellent in sensitivity, residual potential and stability for repetition.

EXAMPLE 10

A photosensitive member was prepared according to the same manner as Example 1 except that an apparatus as shown in FIG. 15 was used, and $C_8H_8$ was used as vaporized in tank (32). The conditions and properties obtained were shown in Table 1.

EXAMPLE 11

A photosensitive member was prepared according to the same manner as Example 1 using the apparatus of FIG. 13. Conditions and results are shown in Table 1.

TABLE 1

| | Exam. No. | | | | | | | | | | |
|---|---|---|---|---|---|---|---|---|---|---|---|
| | 1 | 2 | 3 | 4 | 5 | 6 | 7 | 8 | 9 | 10 | 11 |
| raw material | $C_2H_4$ | $C_2H_4$ | $C_2H_4$ | $C_2H_4$ | $C_2H_4$ | $C_2H_4$ | $CH_4$ | $C_3H_6$ | i-$C_4H_{10}$ | $C_8H_8$ | $CH_4$ |
| flow rate of raw material (sccm) | 30 | 30 | 30 | 90 | 180 | 240 | 100 | 80 | 180 | 50 | 30 |
| $H_2$ (sccm) | 40 | 40 | 40 | 120 | 240 | 320 | 100 | 20 | 120 | 0 | 30 |
| pressure (Torr) | 0.5 | 0.5 | 0.5 | 0.5 | 0.5 | 0.5 | 0.2 | 1.0 | 0.5 | 0.25 | $2 \times 10^{-3}$ |
| power (Watts) | 100 | 100 | 100 | 300 | 600 | 800 | 600 | 200 | 500 | 75 | 5 |
| DC bias (A) | 0 | 0 | +60 | +120 | +140 | +160 | +300 | 0 | +200 | 0 | +600 |
| time for the layer formation (hr.) | 4 | 4 | 8 | 8 | 8 | 8 | 16 | 6 | 8 | 2 | 8 |
| preheat temp. of substrate (°C.) | 250 | 250 | 240 | 240 | 240 | 240 | 50 | 150 | 240 | 250 | 250 |
| anneal temp. (°C.)[1] | — | — | — | — | — | — | 300 | — | — | — | — |
| layer thickness (μm) | 5 | 5 | 5.7 | 12 | 16 | 17 | 5.2 | 7.3 | 10 | 6.8 | 5 |
| CGL[2] | a-Si (1μ) | styrene | a-Si (0.5μ) | a-Si (0.5μ) | a-Si (0.5μ) | a-Si (0.5μ) | a-Si (0.5μ) | a-Si (0.5μ) | a-Si (0.5μ) | a-Si (0.5μ) | a-Si (1μ) |
| hydrogen content (atomic %) | 50 | 50 | 56 | 49 | 37 | 30 | 41 | 60 | 45 | 46 | 10 |
| $V_0$ (V) | −300 | +250 | −330 | −490 | −450 | −390 | −150 | −420 | −330 | −380 | −250 |
| $E_{\frac{1}{2}}$ (lux · sec.) | 2.0 | 5 | 2.0 | 3.5 | 5.0 | 5.8 | 5.3 | 5.7 | 4.5 | 2.2 | 2.2 |
| Egopt (eV) | 2.60 | 2.60 | 2.30 | 1.98 | 1.59 | 1.50 | 1.65 | 2.81 | 1.70 | 2.33 | 1.60 |
| ε | 2.53 | 2.53 | 2.4 | 3.2 | 4.5 | 5.4 | 3.4 | 2.3 | 4.2 | 2.7 | 6.0 |
| residual potential | O | O | O | O | O | Δ | O | Δ | O | O | Δ |
| stability for repetition | O | O | O | O | O | Δ | O | Δ | O | O | Δ |

[1]5 hours in argon;
[2]carrier generating layer

COMPARATIVE EXAMPLE 1

An a—Si photosensitive member having an a—Si charge generating layer 5 μm thick was prepared according to the same manner as the process (II) in Example 1, but the process (I) (preparation of C:H layer) was omitted.

The obtained photosensitive member had an initial surface potential (Vo) of −100 V and $E_{\frac{1}{2}}$ of 0.7 lux.sec., but had an insufficient charging capacity at a positive polarity and gave an unclear copy. Results were shown in Table 2.

COMPARATIVE EXAMPLE 2

A photosensitive member was prepared by coating a polyethylene layer formed by the conventional organic polymerization on a substrate instead of the C:H layer prepared at the process (I) of Example 1 and then applying the process (II) on the coated layer. The charging capacity of the photosensitive member was similar to the photosensitive member of Example 1, but sensitivity was insufficient, that is, the reduction of potential by exposure did not reach to even a half value of the initial one. The results were shown in Table 2.

COMPARATIVE EXAMPLE 3

Figure 16:
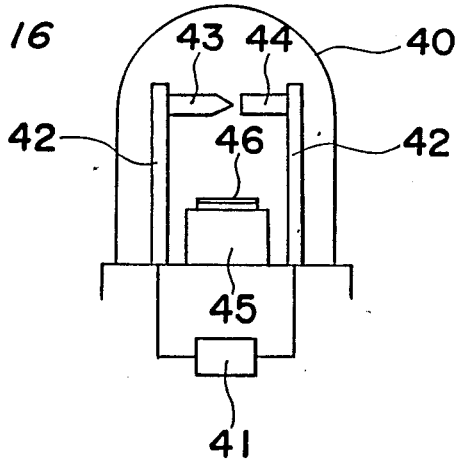
FIG. 16 shows an apparatus for arc deposition used in a comparative example.

A carbon layer not containing hydrogen was prepared using an arc discharge vapor deposition apparatus as shown in FIG. 16, in which an electrode supporting rods (42) and (44), connected with an power source (41), were equipped in a vacuum container (40), an Al substrate (46) was placed on a supporter for a substrate (45) having carbon electrodes (43) and (44), and an arc discharge was generated under a container pressure of $10^{-5}$ Torr and an electric current to carbon electrode of 50 Å to deposit a carbon layer not containing hydrogen in a thickness of 5 μm on the Al substrate.

The obtained carbon layer had a resistance of less than $10^8$ Ω.cm not to be used as a photosensitive member for electrophotography.

When an a—Si layer was formed on the carbon layer under the same condition as in Example 1, the a—Si layer was exfoliated from the carbon layer. The results are described in Table 2.

TABLE 2

| | Comparative Example | | |
|---|---|---|---|
| | 1 | 2 | 3 |
| carrier generating layer | a-Si (5μ) | a-Si (1μ) | a-Si (1μ) exfoliated |
| hydrogen content (atomic %) | — | 67 | 0 |
| $V_0$ (v) | −60 | −600 | — |
| $E_{\frac{1}{2}}$ (lux · sec) | 7 | not reached to half reduction | — |
| Egopt (eV) | — | larger than 4 | — |
| relative dielectric const. | 12 | 2.3 | — |
| residual potential | x | x | — |
| stability for repetation | x | x | — |

What is claimed is:

1. A photosensitive member comprising:

an electrically conductive substrate;

a charge generating layer; and a charge transporting layer comprising hydrogen-containing carbon, said hydrogen being contained in an amount of about 40 to 67 atomic % based on the amount of carbon, and said charge transporting layer having an optical energy gap of about 1.5 to 3.0 eV and relative dielectric constant of about 2.0 to 6.0.

2. A photosensitive member comprising:

an electrically conductive substrate;

a charge generating layer; and a charge transporting layer comprising amorphous carbon containing hydrogen, said hydrogen being contained in an amount of about 0.1 to 67 atomic % based on the amount of carbon, and said charge transporting layer having a relative dielectric constant of about 2.0 to 6.0.

3. A photosensitive member of claim 2, in which the charge transporting layer has an optical energy gap of about 1.5 to about 3.0 eV.

4. A photosensitive member of claim 2, in which the charge transporting layer has a thickness of about 5 to 50 μm.

5. A photosensitive member of claim 2, in which the hydrogen content is preferably about 30 to about 60 atomic percent based on the carbon.

6. A photosensitive member of claim 2, in which the charge transporting layer is formed by organic plasma polymerization.

7. A photosensitive member comprising:

an electrically conductive substrate;

a charge generating layer; and a charge transporting layer comprising amorphous carbon containing hydrogen, said hydrogen being contained in an amount of about 0.1 to 67 atomic % based on the amount of carbon, and said charge transporting layer having an optical energy gap of about 1.5 to 3.0 eV, and a relative dielectric constant of about 2.0 to 6.0.

8. A photosensitive member of claim 7, in which the charge transporting layer has a thickness of about 5 to 50 μm.

9. A photosensitive member of claim 7, in which the hydrogen content is preferably about 30 to about 60 atomic percent based on the carbon.

10. A photosensitive member of claim 7, in which the charge transporting layer is formed by organic plasma polymerization.

11. A process for producing a photosensitive member by organic plasma polymerization, said process including:

introducing gaseous material comprising at least amorphous carbon containing hydrogen into a reactor chamber;

heating a substrate; and causing plasma discharge into said reactor chamber after said introduction of gaseous material to form on the heated substrate a charge transporting layer of amorphous carbon comprising hydrogen by applying an electric power of about 0.05 to 1 kV.

12. A photosensitive member comprising:

an electrically conductive substrate;

a charge generating layer; and a charge transporting layer comprising at least amorphous carbon containing hydrogen, said hydrogen being contained in an amount of about 0.1 to 67 atomic % based on the amount of carbon, and said charge transporting layer having a relative dielectric constant of about 2.0 to 6.0 and having essentially no photosensitivity.

* * * * *